United States Patent [19]

Logel et al.

[11] Patent Number: 4,654,508

[45] Date of Patent: Mar. 31, 1987

[54] ELECTRO-DOMESTIC OVEN HAVING A CATALYTIC REACTOR WITH A DEPRESSION BAFFLE

[75] Inventors: Bernard Logel, Gundershoffen; Jean-Charles Reymann, Mertzwiller, both of France

[73] Assignee: Societe De Dietrich & Cie, S.A., France

[21] Appl. No.: 698,897

[22] Filed: Feb. 6, 1985

[30] Foreign Application Priority Data

Feb. 6, 1984 [FR] France ..... 84 01889

[51] Int. Cl.[4] ..... F27B 5/16; F27D 11/00

[52] U.S. Cl. ..... 219/400; 126/21 A; 219/391

[58] Field of Search ..... 219/400, 391, 392, 393, 219/394, 395, 396, 397, 398; 126/21 R, 21 A

[56] References Cited

U.S. PATENT DOCUMENTS

| | | | |
|---|---|---|---|
| 2,177,223 | 10/1939 | O'Dowd | 126/21 R |
| 2,511,328 | 6/1950 | Cline | 219/400 |
| 3,310,046 | 3/1967 | Scott | 126/21 R |
| 3,499,430 | 3/1970 | Kemp | 126/21 R |
| 3,612,032 | 10/1971 | Kweller | 126/21 A |
| 4,163,894 | 8/1979 | Scherer | 219/391 |

FOREIGN PATENT DOCUMENTS

| | | | |
|---|---|---|---|
| 1811760 | 7/1969 | Fed. Rep. of Germany . | |
| 2003530 | 8/1970 | Fed. Rep. of Germany | 126/21 A |
| 2305025 | 8/1974 | Fed. Rep. of Germany | 126/21 A |
| 2329024 | 2/1975 | Fed. Rep. of Germany . | |
| 1503314 | 3/1978 | United Kingdom | 126/21 A |

*Primary Examiner*—E. A. Goldberg
*Assistant Examiner*—Teresa J. Walberg
*Attorney, Agent, or Firm*—Beall Law Offices

[57] ABSTRACT

An electric domestic oven includes an air exhaust channel above the exit from a catalytic reactor. A depression baffle is located in the air exhaust channel to provide a suction orifice in the area of the catalyser unit to draw cooling and cleaning gases from the cooking compartment. The depression baffle has a curved upstream portion and a ramp-shaped downstream portion. A deflector may be placed above the baffle in the channel.

16 Claims, 7 Drawing Figures

ELECTRO-DOMESTIC OVEN HAVING A CATALYTIC REACTOR WITH A DEPRESSION BAFFLE

BACKGROUND OF THE INVENTION

The present invention relates to an electric oven having a catalytic reactor with or without pyrolytic cleaning.

Numerous electric ovens are equipped with a catalytic reactor for the purpose of treating cooking food gases during the stages of catalytic or pyrolytic cleaning of the projections, especially when greasy, on the walls and other receiving surfaces.

This catalyser produces oxidation of carbon monoxide molecules to transform them into carbonic gas.

Although in large quantities it becomes dangerous to man, the carbonic gas molecule is saturated in the natural state and consequently does not present the immediate danger of oxygen hungry carbon monoxide.

From this fact a catalytic reactor saturating carbon monoxide has become necessary in many ovens and particularly in pyrolytic or catalytic cleaning ovens.

Research and experiments have demonstrated that in order to obtain optimum functioning of the catalytic reactor, the four following general conditions must be fulfilled:

All exhaust gases either from cooking food or from carbonization of food residues must pass by the catalytic reactor.

Time in transit (RG) of those gases along the sides of the catalyser channels must be close to the following optimum value:

$$RG = \frac{VG}{t \times VR} = \frac{\text{Gas Volume}}{\text{time} \times \text{reactor volume}}$$

Reactor dimensions must be sufficient so as not to saturate it too quickly during cooking or cleaning.

Treatment temperature of the gases must be appropriate, that is, of the order of 400°–600° C. according to the type of catalyser used.

SUMMARY OF THE INVENTION

The present invention relates to the first condition, the following conditions being more particularly related to the dimensions of the catalyser and to the operating temperature of the oven.

On present ovens there does not exist a special mechanical device for the exhaust of gases coming out of the catalyser. In fact, one takes advantage of the overpressure caused by the increase of air volume because of the exothermic chemical reaction in the chamber. Most of the gases by the body of the catalyser crossed by channels, because they form the preferred exhaust by natural draught.

At the catalyser exit, gases escape by natural draught, either directly to the exterior by a back chimney, or in the auxiliary exhaust channel in the case of an exit on the front face and of a catalyser crossing the upper wall of the muffle.

Now, as a practical matter, if most of the gases exits through the catalyser, the latter's passage section will become insufficient to completely exhaust the additional volume and parasite part of the gases will escape by the entrance of lower air and by the auxiliary passages formed by the assembly and manufacturing sets and multiple orifices and technical intervals located on the walls of the muffle. This parasite part of the gases does not cross the catalyser where it would be treated. Those secondary gases and fumes have a high proportion of carbon monoxide and could be a danger in small kitchens often found in dwellings.

To obviate this disadvantage, the inventors have conceived an association of means that, without additional energy, will create a depression sufficient to steer the assembly of gases and fumes towards the catalyser so as to exhaust them outside of the muffle, through the catalyser and to discharge them with the air extracted.

In a very advantageous manner, two of the means employed relate to the aspiration pump and the air ejection channel occupying the intermediary volume predetermined by insulation of the muffle and the exterior envelope.

The general inventive concept consists in utilizing the depression effect caused by a baffle having an aerodynamic profile, and arranged on the catalyser exit, in the extraction air flux which gives rise to an intake of air at the catalyser level.

More precisely, the invention consists in placing a baffle shaped according to the top face of an airplane wing, in the forced ventilation channel of the chamber, above the catalyser exit, the top face being provided with an aspiration orifice corresponding to the catalyser part.

As has already been partially mentioned above, the invention has several particularly interesting advantages:

Considerable decrease of parasite discharges by auxiliary air intakes and technical orifices and passages.

Removal of the supplemental insulation channel.

Utilization of the air intake caused by the extraction pump.

Possibility of improving the cross section by stamping in the exterior upper wall of the muffle.

Full yield of the catalytic reactor.

Certain joints (lighting, sound passage . . . ) present on the sides of the muffle can be removed.

Possible variation of the depression inertia by varying the technical forms and the air speed in the driving air stream.

In addition, sufficient extraction of inside air during cooking, brings a noticeable improvement of the following points. The invention allows for:

Rapid exhaust of smoke formed in the course of cooking moist food.

Immediate mixture of hot gases coming out of the catalyser with air from the ventilator and the driving air stream.

To improve the cooking process by better exhaust causing an increase of oxygenation and removal of carbon monoxide.

To decrease offensive cooking odors in the kitchen and adjoining rooms.

Removing from the oven and destroying odors of grease projections on the warm parts thus improving the taste of the food which is no longer cooked in an atmosphere of grease vapors.

BRIEF DESCRIPTION OF THE DRAWINGS

Other technical characteristics and advantages of the invention will become more apparent from the following description made as a non limiting example of a few modifications of the embodiments of the invention, by referring to the accompanying drawings in which:

FIG. 3 is a transversal cross section view of the exhaust channel, in the case of an embodiment with an upstream deflector.

DETAILED DESCRIPTION OF THE PREFERRED EMBODIMENTS

Figure 1:
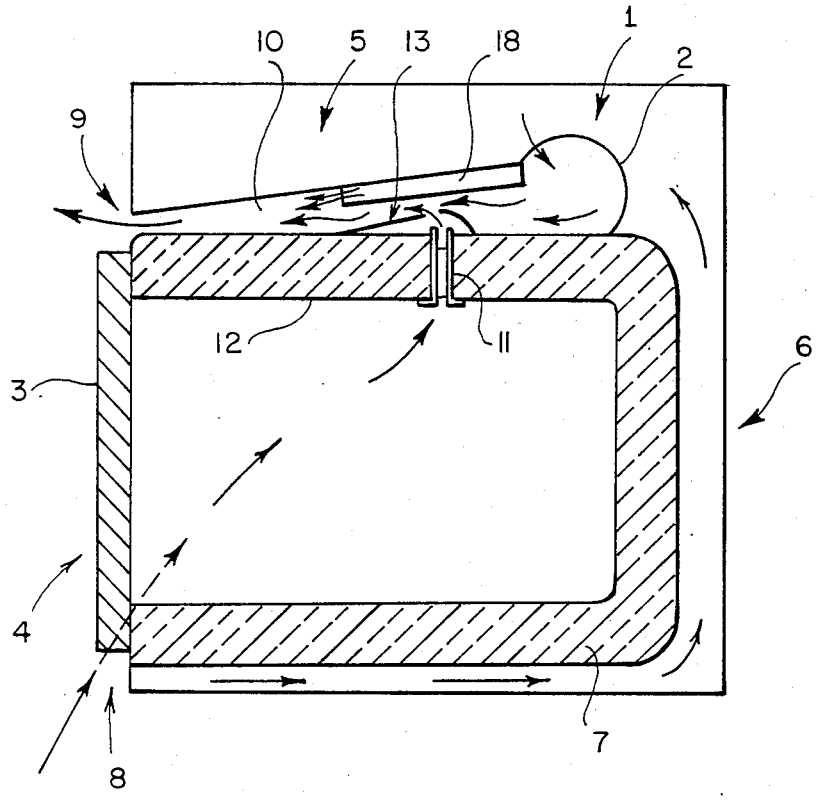
FIG. 1 is a general schematic view in vertical section of an oven including the improvement according to the invention.
Figure 2:
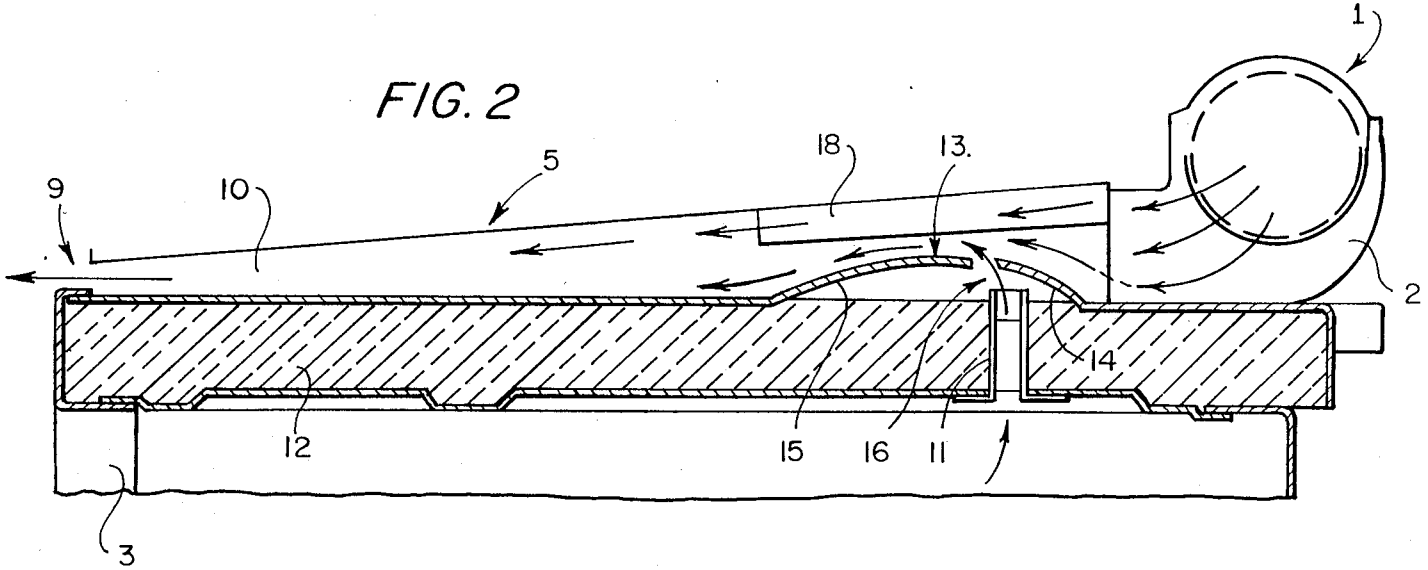
FIG. 2 is a longitudinal cross section detailed view of the upper part of an oven including the improvement according to the invention.

The present invention applies mainly but not exclusively to electrodomestic ovens comprising an air extraction device between the insulation of the muffle and the envelope by an assembly 1 in a high position, with a pump 2 blowing the extracted air in front above the door 3 of the oven 4, by a horizontal ejection channel 5 having walls converging toward the exit. Cooling of the sides comes from air circulation between the exterior chamber 6 and the muffle 7 from the entry of lower air 8 until the exit 9 of the air stream 10 in front, after its passage along channel 5.

The invention applies also to ovens provided with a catalytic reactor 11 located through the upper side 12 of the muffle, for instance, in the central part, discharging in channel 5.

The invention applies more particularly to pyrolytic and catalytic ovens, systematically comprising a catalytic reactor.

During pyrolytic cleaning, an input of fresh air is necessary to permit good combustion of the residues to be eliminated. This input of fresh air comes from the lower part by natural air intake because of overheating prevailing at the interior of the oven.

As indicated in the introduction, the burned gases coming from muffle 7 through catalyser 11 until now were exhausted by an independent auxiliary channel, located in the channel 5 in order not to be influenced by the contrary overpressure caused by the air stream 10.

This configuration causes compression of combustion gases which gives rise to overpressure in the muffle and helps those gases to escape by the openings that can be located on the sides of the muffle (insufficiently airtight door, tress joint, passage of the probe, thermostat, turbine, turning-spit . . . ).

According to the invention, the exit of the catalytic reactor 11 is covered with a profiled depression baffle 13 having a profile of a plane wing having an attack edge 14 directed toward the pump and escape ramp 15 spreading along channel 5 dowstream from exit 16 of catalytic reactor 11.

Figure 5:
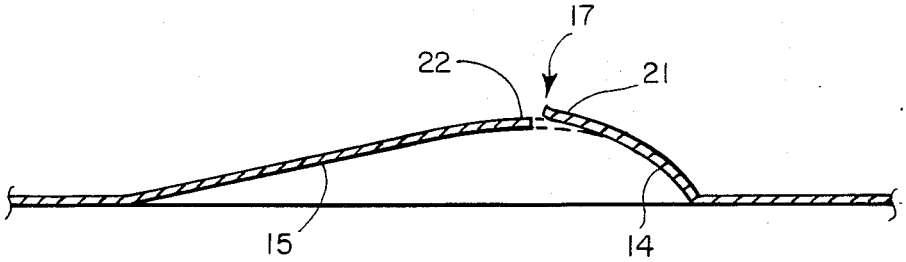
FIGS. 5, 6 and 7 are longitudinal cross section schematic views of a few possible profile forms for the depression baffle.
Figure 6:
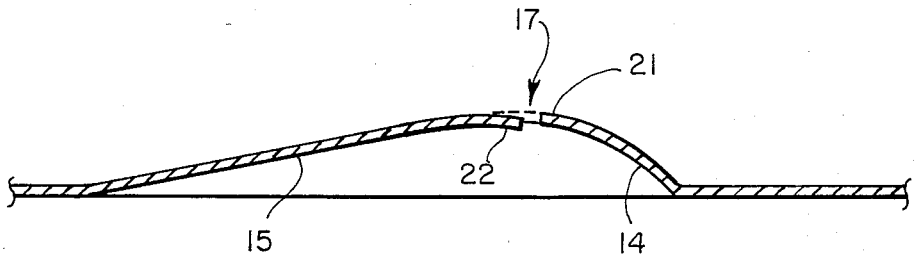
Figure 7:
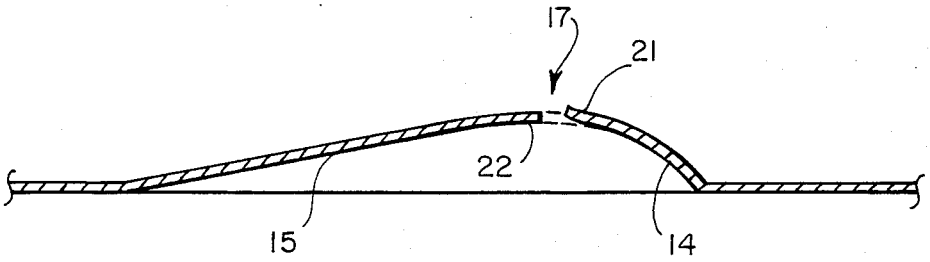

As will be seen below, this suction opening can have various technical forms according to the effects and advantages sought after. The most important variations are shown in FIGS. 5 to 7.

In a general way, the suction opening of the baffle will present the form of an opening, preferably rectangular, 17, having edges slightly diverging in relation to each other.

Better results are obtained by inserting in channel 5 above the depression baffle 13, a deflector 18 having the purpose of deviating and concentrating the air stream 10 on the baffle 13 and particularly on its suction opening. This deflector forms an air passage and occupies only part of channel section 5 in height and in width, in a manner as not to cause appreciable loss of charge for the pump which would no longer function in its normal conditions of use.

Figure 4:
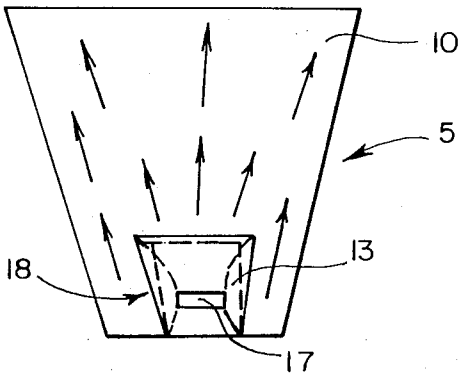
FIG. 4 is a plan view of the ejection channel of the air extracted, showing the form and location of the profiled baffle, according to the improvement of the invention.

As can be observed on FIG. 4, the deflector 18 takes on, in a horizontal plan, a slightly divergent form towards the front of the oven. It occupies a central position starting from the entrance of ejection channel 5. Its passage section is rectangular in principle, in such manner that its lower wall 19 forms with the baffle an intake volume 20 in inverse double convergence Venturi type, which favors the suction effect. Its projected surface covers about that of the baffle 13.

Interposition of this deflector brings at least three main advantages:

- The lower wall 19 lines the air jet on the baffle thus noticeably increasing the depression effect.
- Creation of a double convergence increases the suction effect.
- Presence of the deflector allows diverting the central air flux in the channel which had the tendency of concentrating along the central zone in the extension of the width of the turbine. Moreover, two lateral channels are formed assuring complete air homogenisation and, consequently, a better mixture in the ejection channel.

Other possible forms of the depression baffle 13 and openings are shown on FIGS. 5 to 7. According to their technical forms, they allow for obtaining slightly different effects.

Thus, the numerous variations shown differ especially in the deformation by incline of the longitudinal edges of opening 17.

In FIG. 4, the upstream edge 21 of the opening has a slight curve toward the top while the downstream ramp 22 remains straight in the extension of the escape ramps 15.

Inversely, in FIG. 6, the upstream edge 21 remains in the extension of the curvilinear attack line slope which the downstream ramp 22 has a slight curve towards the lower part.

Variation of FIGS. 3 and 7 unites on each of the edges the above-mentioned deformations.

This latter variation increases the effect and the intake flow thanks to the form of the opening edges favoring the outflow of exiting gases.

The exterior form of the baffle could vary slightly as well as the position of the opening. Experiments have demonstrated that those forms and positions were not definite and that results were still obtained to a lesser degree, but not very different for neighboring forms and positions.

It will be noted that there is no need to manufacture separately the depression baffle 13 and insert it on the upper horizontal wall of the muffle. On the contrary, one of the advantages of the invention consists in conforming the baffle 13 in the very sheet metal forming the upper exterior envelope of the muffle.

In addition, with the catalytic reactor operating with full yield, it is possible, in certain cases, to slightly vary the flow of passing gas.

The invention has been described above in detail and it is of course understood that various modifications and variations without further inventive concept will be included within the scope of the invention and entitled to the protection thereon.

What we claim is:

1. An oven, comprising:

an outer envelope, an inner muffle and a door, together defining an inner cooking compartment and oven wall cooling air passageway between the outer envelope and the muffle;

a passage extending through the muffle;

an air pump for passing a stream of environment air through the cooling air passageway and past the muffle passage;

a profile depression baffle having the crosssectional shape in the cooling air flow direction of an airplane wing with a curved upstream portion and a longer ramp-shaped downstream escape portion, said baffle having an opening between said curved upstream portion and said ramp downstream portion, said profiled depression baffle being means for producing a suction at said opening for drawing cooking and cleaning gases from said compartment, through said opening and into the cooling air stream; and a catalytic reactor in said muffle passage.

2. The oven of claim 1, wherein said opening is elongated in the direction transverse to the air stream and perpendicular to the muffle passage.

3. The oven of claim 2, further including a deflector extending generally parallel to the air cooling passage wall opposite from said profile depression baffle and being closely adjacent said profile depression baffle for improving the low speed suction function of the baffle while providing sufficient high speed air volume.

4. The oven of claim 3, wherein said deflector has side walls that diverge from each other in the downstream direction and are spaced from the air cooling passage side walls.

5. The oven of claim 4, wherein said air cooling passage has side walls that diverge from each other in the downstream direction generally parallel to said deflector side walls.

6. The oven of claim 5, wherein the upstream edge of said opening is curved away from the muffle passage and the downstream edge of said opening is curved toward said passage.

7. The oven of claim 6, wherein said opening is located in the downstream direction from said muffle passage.

8. The oven of claim 1, wherein the upstream edge of said opening is curved away from the muffle passage.

9. The oven of claim 8, wherein the downstream edge of said opening is curved toward said passage.

10. The oven of claim 1, wherein the downstream edge of said opening is curved toward said passage.

11. The oven of claim 10, wherein said opening is located in the downstream direction from said muffle passage.

12. The oven of claim 1, further including a deflector extending generally parallel to the air cooling passage wall opposite from said profile depression baffle and being closely adjacent said profile depression baffle for improving the low speed suction function of the baffle while providing sufficient high speed air volume.

13. The oven of claim 12, wherein said deflector has side walls that diverge from each other in the downstream direction and are spaced from the air cooling passage side walls.

14. The oven of claim 13, wherein said air cooling passage has side walls that diverge from each other in the downstream direction generally parallel to said deflector side walls.

15. The oven of claim 1, wherein said opening is located in the downstream direction from said muffle passage.

16. The oven of claim 15, wherein said opening is elongated in the direction transverse to the air stream and perpendicular to the muffle passage.

* * * * *